US008834065B2

(12) United States Patent
Hart et al.

(10) Patent No.: US 8,834,065 B2
(45) Date of Patent: Sep. 16, 2014

(54) WATER DETENTION SYSTEM INCORPORATING A COMPOSITE DRAINAGE MEMBRANE

(75) Inventors: Peter Hart, Bath (GB); Stephen Richard Spikes, Bristol (GB)

(73) Assignee: Formpave Holdings, Limited (GB)

( * ) Notice: Subject to any disclaimer, the term of this patent is extended or adjusted under 35 U.S.C. 154(b) by 886 days.

(21) Appl. No.: 12/749,353

(22) Filed: Mar. 29, 2010

(65) Prior Publication Data

US 2010/0272514 A1 Oct. 28, 2010

Related U.S. Application Data

(63) Continuation-in-part of application No. 11/891,200, filed on Aug. 8, 2007, now abandoned, which is a continuation of application No. PCT/GB2006/000474, filed on Feb. 9, 2006.

(30) Foreign Application Priority Data

Feb. 11, 2005 (GB) ..... 0502861.8
Aug. 17, 2005 (GB) ..... 0516866.1

(51) Int. Cl.
*E01C 3/00* (2006.01)
*E01C 3/06* (2006.01)
*E01F 5/00* (2006.01)

(52) U.S. Cl.
CPC .... *E01C 3/06* (2013.01); *E01F 5/00* (2013.01)
USPC ..... 405/36; 405/38; 405/53

(58) Field of Classification Search
USPC ..... 405/36, 38, 43, 50, 53, 302.7
See application file for complete search history.

(56) References Cited

U.S. PATENT DOCUMENTS

| | | | | |
|---|---|---|---|---|
| 4,154,549 | A | 5/1979 | Zaslavsky et al. | |
| 4,768,897 | A | 9/1988 | Nussbaumer et al. | |
| 5,651,641 | A * | 7/1997 | Stephens et al. | 405/302.6 |
| 5,823,706 | A | 10/1998 | Hoare et al. | |
| 6,120,210 | A * | 9/2000 | Hsu | 405/50 |
| 6,146,051 | A * | 11/2000 | Pratt | 404/2 |
| 8,256,989 | B2 * | 9/2012 | Burkhardt et al. | 405/36 |
| 2002/0044842 | A1 | 4/2002 | Ianniello et al. | |

(Continued)

FOREIGN PATENT DOCUMENTS

| | | |
|---|---|---|
| DE | 381 4589 | 11/1989 |
| EP | 1045071 | 10/2000 |

(Continued)

*Primary Examiner* — John Kreck
(74) *Attorney, Agent, or Firm* — Weide & Miller, Ltd.

(57) ABSTRACT

A water detention system comprises a sub-base of crushed rock or stone overlying an impermeable layer which may be naturally-occurring, as in an impermeable sub-grade, or may be formed by an impermeable membrane laid over the sub-grade prior to the sub-base layer. Over the sub-base layer is an incompletely impermeable layer the impermeability of which is compromised by openings in the form of slits or by spacing between adjacent strips forming the layer. These openings allow water to percolate downwardly through the layer into the sub-base, but substantially inhibit the escape of moisture by evaporation thereby serving to retain the collected water. Above the incompletely impermeable layer may be a laying course of finer particulate material such as pea gravel over which may be laid a wear surface of slabs or blocks to form an area for traffic, such as a roadway or parking area.

20 Claims, 10 Drawing Sheets

(56) References Cited

U.S. PATENT DOCUMENTS

| | | | | |
|---|---|---|---|---|
| 2004/0067103 | A1* | 4/2004 | Hart | 404/2 |
| 2004/0131423 | A1 | 7/2004 | Ianniello et al. | |
| 2005/0025582 | A1* | 2/2005 | Ianniello | 405/302.4 |
| 2008/0003059 | A1* | 1/2008 | Hart | 405/36 |

FOREIGN PATENT DOCUMENTS

| | | | |
|---|---|---|---|
| GB | 2 243 108 | | 10/1991 |
| GB | 2 390 867 | | 1/2004 |
| JP | 07331602 | A * | 12/1995 |
| WO | WO 2006/077421 | | 7/2006 |
| WO | WO2006-077421 | A1 * | 7/2006 |

* cited by examiner

WATER DETENTION SYSTEM INCORPORATING A COMPOSITE DRAINAGE MEMBRANE

PRIOR APPLICATION DATA

This application claims priority to and is a continuation-in-part of U.S. patent application Ser. No. 11/891,200 now abandoned, filed on Aug. 8, 2007 entitled A Water Detention System Incorporating a Composite Drainage Membrane, which is a continuation of PCT Application No. PCT/GB2006/000474, filed on Feb. 9, 2006, entitled A Water Detention System Incorporating A Composite Membrane, which claims priority to Great Britain patent application number 0502861.8 filed Feb. 11, 2005 and Great Britain patent application number 0516866.1 filed Aug. 17, 2005.

FIELD OF THE INVENTION

The present invention relates generally to a composite drainage membrane, and to a water detention system incorporating such a membrane.

RELATED ART the use of suds (sustainable urban drainage systems) is increasing with the increasing awareness of the economy of installation and value in decontaminating and managing the water collection and drainage systems leading to water courses for the disposal of water falling on pavement surfaces. Known drainage systems are built to cope with a maximum expected precipitation, which may be exceeded from time to time. Changing meteorological conditions, however, are leading to situations where the peak rainfall for which a drainage system may have been designed is being exceeded increasingly frequently. Upgrading of systems to cope with increased amounts of run-off is extremely costly. There is also the contaminating and polluting effect of motor traffic resulting in heavy metals, hydrocarbons, rubber dust, silt and other fine detritus becoming deposited on the surfaces of roadways and car parks and subsequently being washed into the water courses causing long term pollution.

Sustainable urban drainage systems utilising permeable pavements and underlying layers of crushed rock over an impermeable sub-grade, or provided with an impermeable lining membrane, may be used to collect and store water for other purposes such as irrigation. When used for this purpose, however, especially in regions of high temperature, evaporation of the stored water, even though located in subterranean voids, can result in effective loss of a large proportion of the water collected.

The present invention seeks, therefore, to provide means by which such systems can be improved to allow rapid infiltration of water into the voids in the sub-base, without there being an opportunity for equally rapid escape by evaporation.

SUMMARY

The present invention finds particular utility in connection with the provision of pavement surfaces, that is hard, load-bearing surfaces made from paving elements such as slabs or blocks, or continuous material such as concrete or asphalt. However, the present invention is not limited to application solely in this field, and may find utility in connection with a wide range of forms of water run-off management, storage, and precipitation re-utilisation systems, particularly those suitable for use with rainwater, as well as systems for decontamination of run-off water and for the use of subterranean water for heat exchange purposes.

According to a first aspect of the present invention, therefore, there is provided a water detention system characterised by comprising at least a sub-base of particulate material in a layer having a substantial number of voids, an overlying permeable layer of particulate material, and a composite membrane comprising a first, permeable layer, a second impermeable layer and spacer means between the first and second layer, the spacer means acting to maintain at least part of the first and second layers out of contact with one another and to allow the movement of liquid in the space between them, the composite membrane being so positioned that water collecting on its surface can infiltrate into the sub-base from the edges of the composite drainage membrane or through openings formed in the second layer.

When used as a separating layer over a sub-base of particulate material defining a plurality of voids, therefore, the composite membrane allows the infiltration of water passing through the permeable layer into the space between the two layers and then travelling laterally, towards the edges of the composite membrane, from which the water can escape into the sub-base.

The form of the composite membrane may vary depending on the particular exigencies of use. For example, in some circumstances it may be quite sufficient for the individual layers simply to be placed in juxtaposed relation one over the other loosely without a bonding between the layers. Because overlying layers will in practice be placed on top of the membrane, for example a laying course and a wearing course, there will be no effective lateral forces between the layers requiring them to be bonded together. For convenience in handling of the membrane, however, they may nevertheless be held together in fixed relation and in one embodiment the components of the membrane are held together by adhesive bonding. Alternatively, however, the component may be held together by fixing elements such as, for example, staples.

In a preferred embodiment of the invention the spacer means comprise a mesh or grid, and in particular a plastics mesh has been found to be particularly appropriate. Of course, since lateral transport of the water between the two layers spaced by the mesh is required a mesh structure which formed closed cells would be of little value and it is preferred, therefore, that the mesh is formed in such a way as to provide communicating or open cell structure when the mesh is placed between the two layers. This may be achieved, for example, by using a mesh formed of overlapping or "woven" filaments.

Another way in which lateral transport of water may be achieved lies in the use of a plurality of discrete elements as the spacer means. Such discrete elements may be irregularly spaced over the surface of the membrane between the two layers or, in order to minimise on the material used, may be regularly spaced over this surface, it being appreciated that regular spacing allows wider separation of the spacer elements. Indeed, it will be appreciated that although the spacer elements hold the two layers out of contact with one another in the region of the elements themselves, it is possible for the two layers to touch between the regions contacted by the spacer elements. In this case the two layers may be secured together between the discrete elements and this, of course, would assist in maintaining the discrete elements in determined positions spaced over the area of the membrane.

Although discrete elements in the form of studs, pebbles, beads or other granular material may be used, these could alternatively be elongate, possibly even spanning the entire width of the membrane, formed as rods, bars or tubes.

It is also within the ambit of the present invention for the second, impermeable layer to be formed with surface formations acting themselves as the spacers. Thus local inspissation, corrugation or embossment of the second layer may serve to hold other regions thereof in the required spaced relation with respect to the permeable layer.

Permeability of the first layer may be achieved by forming this as a woven or non-woven textile material, in which case the fibres or filaments may be heat bonded to make a strong resistant material suitable for use as a geotextile.

The present invention also comprehends a water detention system comprising at least a sub-base of particulate material in a layer having a substantial number of voids, and an overlying composite membrane formed by laying down successive layers in a substantially unbonded juxtaposition, and so positioned that water collecting on the surface can infiltrate into the sub-base at least from the edge of the membrane or through openings formed therein. The intermediate layer in such a structure may be made of stones or crushed rock laid to a depth of between a few cm to several tens of cm.

In a structure suitable for water detention the sub-base may overly an impermeable or at least substantially impermeable underlying layer, and this layer may be a geological formation such as a sub-grade or may be an introduced at least substantially impermeable, underlying layer in the form of a membrane.

The underlying layer need not necessarily be planar, and, indeed, there are circumstances which will be described in more detail below in which irregular further cavities or sumps, or at least one cavity or sump, may be of particular value.

Above the composite membrane of the water detention system there may be a further particulate layer and this may be a laying course for a wearing layer which may comprise a plurality of paving elements and which, in a preferred embodiment, may be blocks or slabs having means defining openings between them when laid in juxtaposed relation.

Alternatively, the wearing layer may comprise a substantially continuous layer of permeable material such as asphalt, porous concrete or the like.

A water detention system formed in locations other than under urban pavements may also be formed, and in such a case the particulate material overlying the composite membrane may itself constitute a wearing layer (for example, gravel laid to a path or drive, or a larger standing area). It could also be entirely unrelated to any traffic or parking system, in which case the further layer may be overlain by soil and/or vegetation. This is of particular value where the water detention system is provided primarily for collection and storage of water for purposes other than simply management of the water run-off. It may be stored, for example, for further use in irrigation, as wash water or even for use in other agricultural environments, such as drinking water for animals.

Infiltration of water resulting from precipitation is achieved particularly effectively if the membrane is laid in strips over the sub-base, and such strips may be lain in such a way that adjacent strips are spaced from one another (in which case water infiltration is maximised) although adequate water infiltration may equally be achieved if the strips of the composite membrane are laid abutting one another or overlapping one another. The strips may be laid on a perfectly horizontal surface of the underlying sub-base, or this may be shaped, for example domed or inclined, to receive the composite membrane.

The present invention also extends to the provision of a pavement structure having an underlying water detention system as defined hereinabove and/or using a composite membrane as defined herein.

Further, the invention may also be considered to lie in a method of forming a water detention system which may comprise the steps of laying a sub-base of rigid insoluble hard particulate material of a defined size range over an at least substantially impermeable sub-grade or a preliminarily positioned at least substantially impermeable membrane and overlying the sub-base with a substantially unidirectionally porous layer able to allow water to infiltrate from above into the sub-base, but which is such as substantially to resist loss of water from the sub-base by evaporation. This method also comprises overlaying the substantially unidirectionally porous layer with a further layer of particulate material.

The method of the invention may further comprises the steps of compacting the material of the sub-base prior to application of the substantially unidirectionally porous layer.

If the substantially unidirectionally porous layer is a composite membrane comprising at least an impermeable layer, a permeable layer and spacer means holding the two layers apart over at least a part of their area, as described hereinabove, these may be applied one at a time to the sub-base to build up the at least substantially unidirectionally porous layer. Indeed, the spacer means may itself comprise a layer of stones or crushed rock.

Alternatively, the substantially unidirectionally porous layer may be a composite membrane as herein defined preliminarily formed before application to the sub-base.

The present invention may also comprehend a heat exchange structure comprising a substantially enclosed volume bounded by a lower water-impermeable stratum or layer and containing a sub-base of rigid substantially incompressible particulate material, overlain by an at least partly permeable membrane which allows water to enter the substantially enclosed volume but resists evaporative escape therefrom. This system also comprises one or more heat exchange pipes for directing a heat exchange fluid therethrough and located so as to pass through water trapped in the substantially enclosed volume.

The substantially enclosed volume may include a channel through which the heat exchange pipe passes, and such channel may be formed by the membrane defining a lower boundary of the enclosed volume. In order to ensure that thermal contact is made with the water even in the most adverse circumstances the channel may be formed as a sump in the bottom of the enclosed volume and the pipe or pipes pass through this sump.

The rigid substantially incompressible particulate material may be crushed rock.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

Various embodiments of the present invention will now be more particularly described, by way of example, with reference to the accompanying drawings, in which.

DETAILED DESCRIPTION

Figure 1:
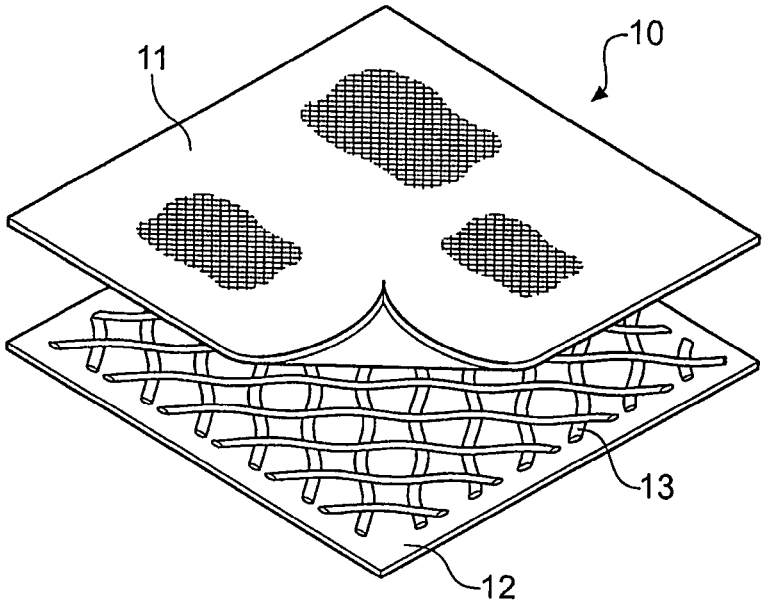
FIG. 1 is an enlarged cross sectional view of a membrane formed as an embodiment of the present invention.

Referring first to FIG. 1, the membrane generally indicated 10 comprises a first layer 11 of non-woven geotextile fabric comprising a plurality of filaments bonded together and having the following properties.

Thermally-bonded non-woven geotextile meeting the following specifications:

| Mechanical Properties | |
|---|---|
| Wide Width Strip Tensile | EN ISO 10319 |
| Mean peak strength | 8.50 kN/m |
| Elongation at peak strength | 28% |
| CBR Puncture Resistance | EN ISO 12236 |
| Mean Peak Strength | 1575N |
| Trapezoidal Tear Resistance | ASTM D4533 |
| Mean Peak Strength | 325N |

| Hydraulic Properties | |
|---|---|
| Pore Size | EN ISO 12956 |
| Mean AOS $O_{90}$ | 0.145 mm |
| Water Flow | EN ISO 11058 |
| Mean Flow $VI_{H50}$ 10−3 m · s−1(1/m$^2$s) | 80 |

-continued

| Hydraulic Properties | |
|---|---|
| Water Breakthrough | BS 6906: Part 3 |
| Mean Head | 50 mm |
| Air Permeability | ISO 9237 |
| Mean Flow | 2875 l/m$^2$ · s |

| Typical Physical Properties | |
|---|---|
| Mass EN 965 | 130 g/m$^2$ |
| Roll width | 4.5 & 1.5 m |
| Roll length | 100 m |
| Colour | Green |

The composite membrane 10 also includes a flexible second layer 12 of impermeable plastics material (such as polyethylene or similar) and sandwiched between the first and second layers 11, 12 is a geogrid or mesh layer (such as high density polyethylene or similar) 13 spacing the two first-mentioned layers apart and providing a plurality of drainage passageways for water to travel parallel to the plane of the backing layer 12.

Figure 2A:
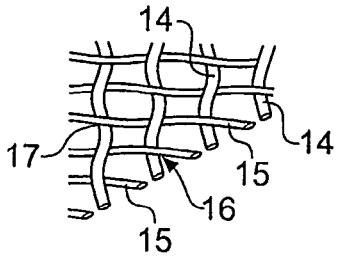
FIG. 2 is an exploded view of a mesh layer forming part of the membrane of FIG. 1.
Figure 2B:
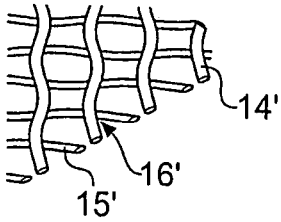

FIGS. 2*a* and 2*b* show two alternative forms of the geogrid 13. This layer is intended to hold the geotextile layer 11 spaced from the impermeable backing layer 12 and to provide drainage channels or passages for water to travel parallel to the plane of the layer 12. For this purpose the grid must provide spaces between itself and the layer 12 when placed in contact with it, and in the embodiment of FIG. 2*a* this is achieved by forming the grid 13 of a plurality of "woven-warp" filaments 14 interlaced with a plurality of "weft" filaments 15. After weaving, the filaments 14, 15 are pressed together and heated to cause bonding in the overlap region such as that identified by the arrow 16 so that the geogrid is stable dimensionally. Passages for water flow are formed by the overlapping filaments as identified by the regions 17 identified in FIG. 2*a*.

A similar, but more economical geogrid is illustrated in FIG. 2*b* where the warp filaments 14' are first laid in parallel rows and/or overlaid by the "weft" filaments 15' which are thereafter pressed and heated to bond the grid together at the intersections 16'. The heating causes partial interpenetration of the material of the warp and weft filaments, but as will be appreciated along the length of either row of filaments there are wide spaces through which water can travel even when the grid is placed in contact with an impermeable surface.

Figure 3:
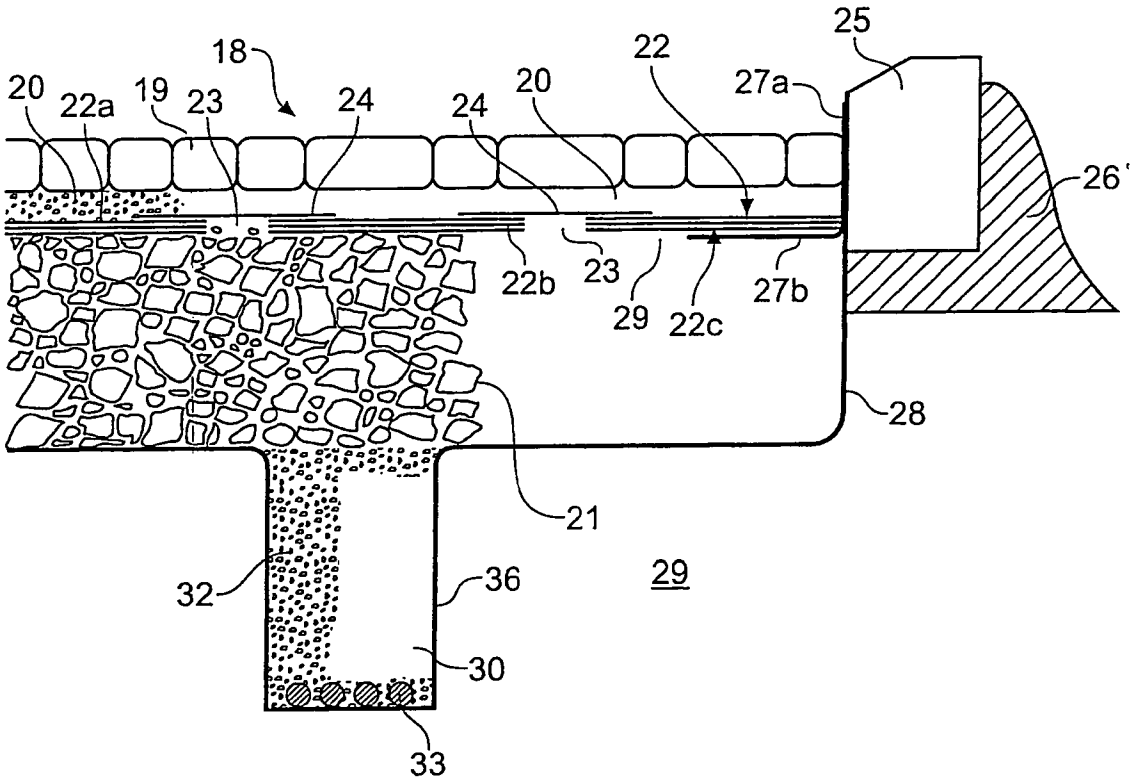
FIG. 3 is a cross sectional view through a water detention system formed as an embodiment of the present invention and incorporating a membrane of the general type illustrated in FIG. 1.

FIG. 3 illustrates in cross section a typical water detention system formed utilising the membrane illustrated in FIGS. 1 and 2. The water detention system illustrated in FIG. 3 underlies a hard paved surface 18 defined by a plurality of individual blocks 19 laid closely spaced with no grouting between them so that channels (not shown) in the sides of the blocks can allow rainwater falling on the surface 18 to pass through into an underlying layer 20 formed as a bedding course for the blocks 19 and composed of relatively small particulate material such as gravel in the range of about 5 mm to about 20 mm.

Beneath this is a sub-base 21 of crushed rock of angular form and a size range of about 163 mm to about 10 mm between which are a significant number of voids providing storage space for water infiltrating through the permeable wearing surface 18. Between the sub-base 21 and the laying course 20 is a composite membrane layer generally indicated 22. This may have the same structure as described in relation to FIG. 1 and, in this embodiment, the membrane 22 is laid in elongate strips 22*a*, 22*b*, 22*c* with spaces 23 between the edges of adjacent strips. Over the spaces 23 is laid a protective strip 24 of porous geotextile material, which may be the same material as that which constitutes the layer 11 of the membrane 10 of FIG. 1. A regulating layer 29 of smaller stones may be laid between the sub-base 21 and the composite membrane 22.

The edges of the installation are defined by a kerb 25 in suitable haunching 26, and escape of water is prevented by a strip 27 of impermeable material laid under the adjacent strip 22*c* of composite membrane and extending up the adjacent face of the kerb 25 between that and the layer of blocks 19. The edging strip 27 thus forms a vertical limb 27*a* and a horizontal limb 27*b*. An impermeable layer or membrane 28 defines the lower boundary of the sub-base 21, lying between this and the sub-grade 29. The membrane 28 likewise extends up the face of the kerb 25 adjacent the limb 27*a* of the edging strip 27 to define an enclosed space below the wearing surface constituted by the blocks 19.

A sump 30 is formed by a channel membrane 36 beneath the sub-base 21 and extending downwardly into the sub-grade 29. The sump 30 is filled with a granular material 32 which is smaller in size than the material of the sub-base 21.

At the bottom of the sump 30 are laid pipes 33 for a heat exchange system. As described herein the water detention system may be used for multiple purposes and not every feature of this embodiment would necessarily be employed in a practical installation. Where the water detention system is provided to act as a heat sink, for example, it is convenient to maintain a significant body of water within the region defined by the sub-base 21 and the sump 30 so that heat yielded from the pipes 30 (through which, in use, a heat exchange liquid or fluid flows from the appliance or installation generating or using the heat which is lost to or drawn from the surrounding water). A further description of such a heat exchange system is to be found in British Patent Application No 0418391.9.

Figure 4:
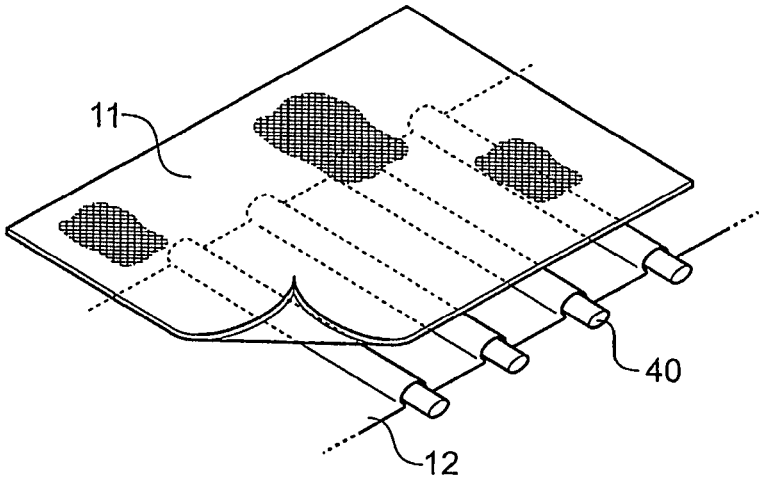
FIG. 4 is a schematic view of an alternative membrane having tubes, rods or bars as spacers.
Figure 4A:
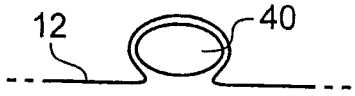
Figure 5:
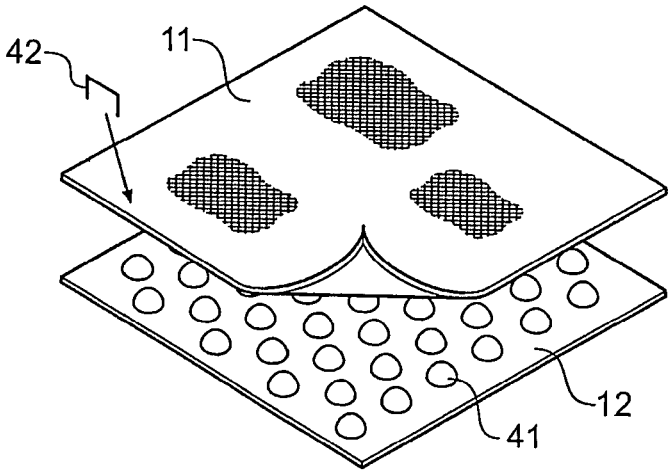
FIG. 5 illustrates the use of beads as spacers.

Alternative forms of composite membrane are illustrated in FIGS. 4 and 5, in which the same reference numerals have been used as those in FIG. 1 to identify the same or corresponding component parts. Thus, the upper geotextile layer 11 is spaced in the embodiment of FIG. 4 from the lower impermeable plastics membrane 12 by a regular array of rods or bars 40 spaced from one another along the length of the strip of membrane 12. The bars 40 extend from side to side of the membrane and define elongate channels in the composite membrane encouraging water to flow in one of two opposite directions. The bars 40 may be secured to the membrane 12 by adhesive, friction welding or other technique, or, as shown in FIG. 4*a*, may be bonded in place by forming the membrane 12 around each rod 40 whilst in a mobile state so that, upon curing or hardening, the membrane 12 itself retains the rod 40 in position.

In FIG. 5 the geotextile 11 is spaced from the membrane 12 by an irregular set of beads 41 spaced over the surface of the membrane 12 and either secured in place by adhesive or located by a direct connection of the geotextile 11 to the membrane 12 by way of fixing elements such as staples 42 over a defined region to form, in effect, pockets between which the beads 41 are trapped.

Figure 6:
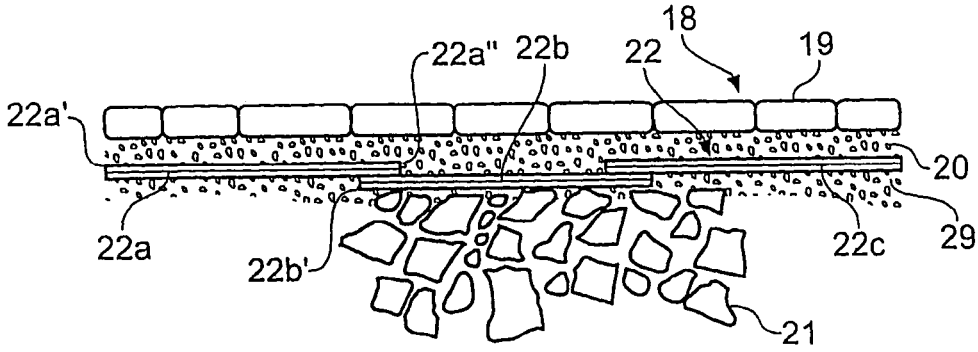
FIG. 6 illustrates one laying configuration for the membrane of FIG. 1 in a water detention system such as that of FIG. 3.

FIG. 6 shows a laying pattern for the composite membrane in a water detention system similar to that illustrated in FIG. 3. Again, the same reference numerals have been used to identify the same or corresponding components. Here, the composite membrane 22 is again laid in strips 22*a*, 22*b*, 22*c*, but in this case they are laid overlapping one another over a regulating layer 29 and under a bedding course 20 overlain by blocks 19 which allow infiltration of water. This laying configuration still allows water to permeate through the permeable membrane 22 since water flowing onto, for example, the strip 22*a* can exit from each of the two opposite edges 22*a*' and 22*a*", and in this latter case the water flows onto the adjacent layer 22*b* from which it can escape through the edge 22*b*'. Water collecting in the sub-base layer 21, however, has an effectively continuous impermeable membrane above it, and evaporation of the water contained in the sub-base 21 even when high temperatures exist above the wearing layer 18 is strongly resisted.

Figure 7:
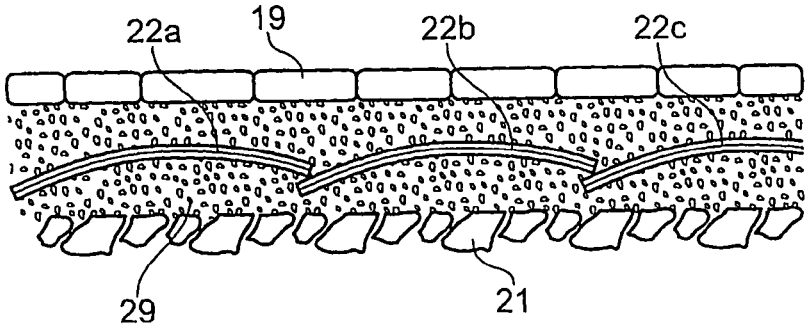
FIG. 7 illustrates a further alternative laying configuration.

FIG. 7 illustrates another alternative laying configuration in which, however, the regulating layer 29 is formed into a cambered or domed configuration matching the dimensions of the strips 22*a*, 22*b*, 22*c* so that the infiltration of water through the membrane 22 into the sub-base 21 is encouraged by gravity. This laying configuration has the disadvantage, however, that the cambered regulating layer 29 must be formed with a shape which is reasonably accurate so as to receive the individual strips 22 of the composite membrane.

Figure 8:
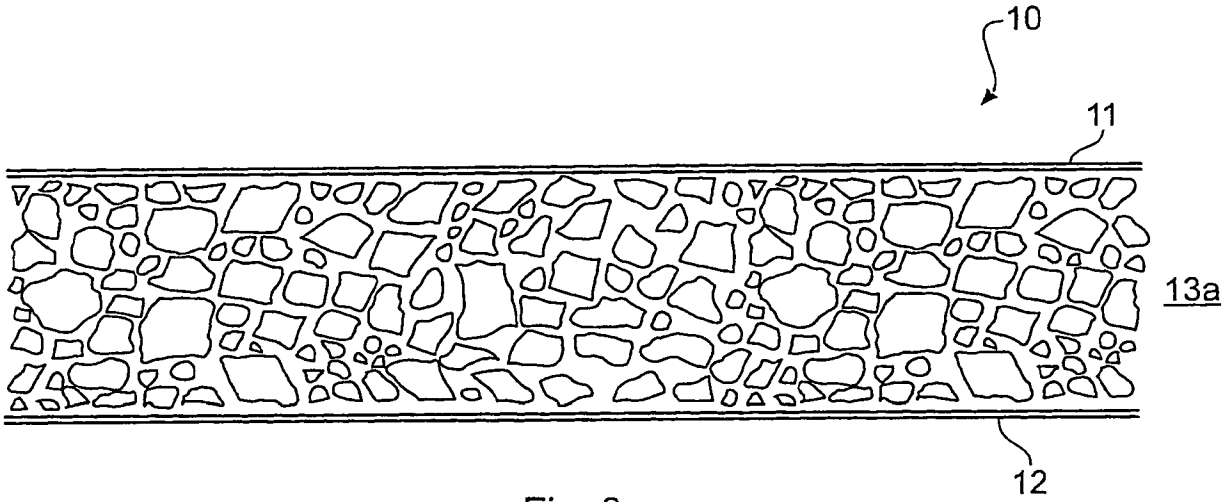
FIG. 8 is an enlarged cross sectional view of a membrane formed as an embodiment of the present invention.

Turning now to FIG. 8, there is shown an assembled structure forming a composite membrane, generally indicated 10 for use in a water detention system of the type described above. The membrane comprises a first layer 11 of non-woven geotextile fabric composed of a plurality of filaments bounded together to form a porous web having properties as set out in relation to the web described with reference to FIG. 1.

The composite membrane 10 also includes a flexible second layer 12 of impermeable plastics material (such as polyethylene or similar), and sandwiched between the first and second layers 11, 12 is a layer 13*a* of crushed rock or stone spacing the two first-mentioned layers apart and providing a plurality of drainage passageways for water to travel parallel to the plane of the backing layer 12. This layer of stone may have a thickness of about 75 mm and have been graded to include particles predominantly of a size 20 mm to 5 mm.

The composite membrane 10 may act as an evaporation control membrane as will be explained in more detail herein.

Figure 9:
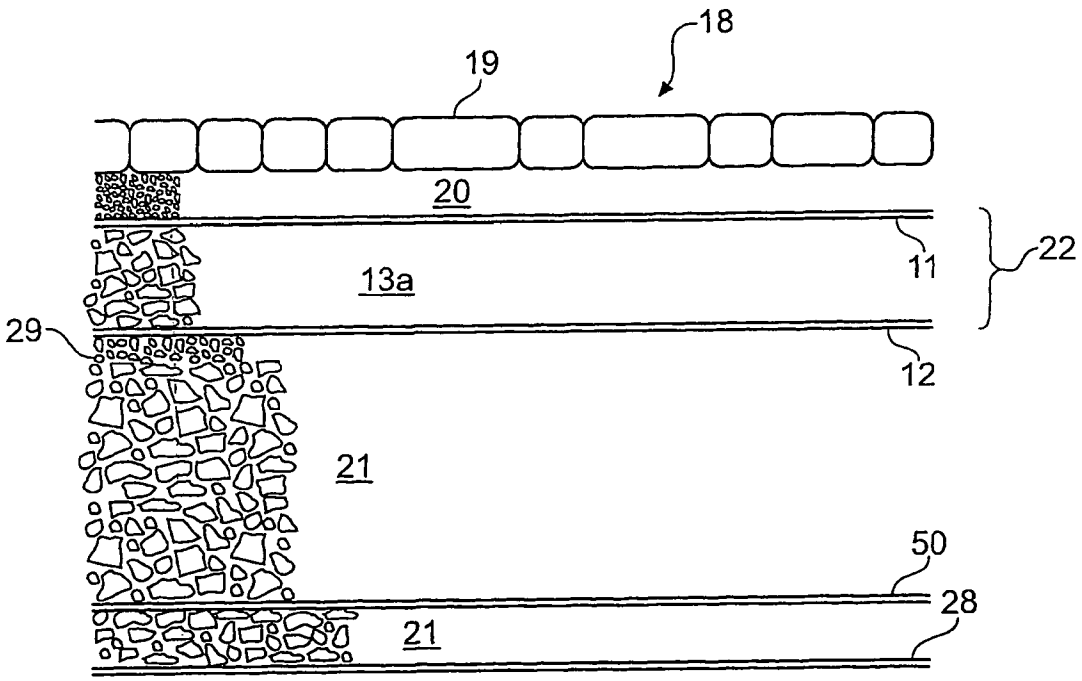
FIG. 9 is a cross sectional view through a water detention system formed as an embodiment of the present invention and incorporating a membrane of the general type illustrated in FIG. 1.

FIG. 9 illustrates in cross section a typical water detention system formed utilising the membrane illustrated in FIG. 8. The water detention system underlies a hard paved surface 18 defined by a plurality of individual blocks 19 laid closely spaced with no grouting between them so that channels (not shown) in the sides of the blocks can allow rainwater falling on the surface 18 to pass through into an underlying layer 20 formed as a bedding course for the blocks 19 and composed of relatively small size particulate material such as gravel in the range of about 5 mm to about 20 mm, more particularly 6 mm.

Beneath this is a sub-base 21 of crushed rock or stone of angular form and graded to have a size range of about 63 mm to about 10 mm between which are a significant number of voids providing storage space for water infiltrating through the permeable wearing surface 18. Between the sub-base 21 and the laying course 20 is a composite membrane layer generally indicated 22. This may have the same structure as described in relation to FIG. 8.

In this embodiment, between the sub-base layer 21 and the underside of the composite membrane 22, a thin blinding layer of regulating stone 29 is provided having a size range of about 20 mm to about 5 mm and having a thickness of about 50 mm. This layer 29 helps to protect the second layer 12 of the composite membrane 22 from puncture by the larger and more angular rocks and stones of the sub-base layer 21.

Further, the embodiment of FIG. 9 has a stabilisation layer 50 shown. This may be a geotextile or a geo-grid such as manufactured by Tensar™. The purpose of this layer is to help stabilise the sub-base 21 and prevent it from being reduced in thickness, which in turn would reduce the volume of water which could be stored within it, due to traffic or natural weathering.

At the base of the structure of FIG. 9 a substantially impermeable layer 28 is shown. This layer 28 may be a man-made impermeable layer such as sheets of substantially continuous plastics, a naturally occurring sub-grade such as a competent rock formation, or an imported naturally occurring material such as clay. This element 28 is not a pre-requisite but does enhance water retention.

Figure 10:
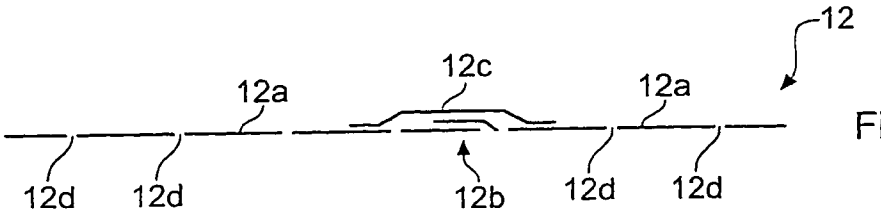
FIG. 10 is a cross sectional view of one laying configuration for the membrane of FIG. 1 in a water detention system such as that of FIG. 2.

FIG. 10 illustrates how the second layer 12 of the composite membrane 22 may be formed of overlapping separate sheets 12*a*. The sheets are overlapped along an edge 12*b* and tapes 12*c* are adhered to the two adjacent sheets 12*a* at the overlap 12*b* to produce a larger continuous sheet. Holes 12*d* may then be punched through the sheets 12*a* in either a regular pattern as shown in FIG. 4 or an irregular pattern (not shown).

Figure 11:
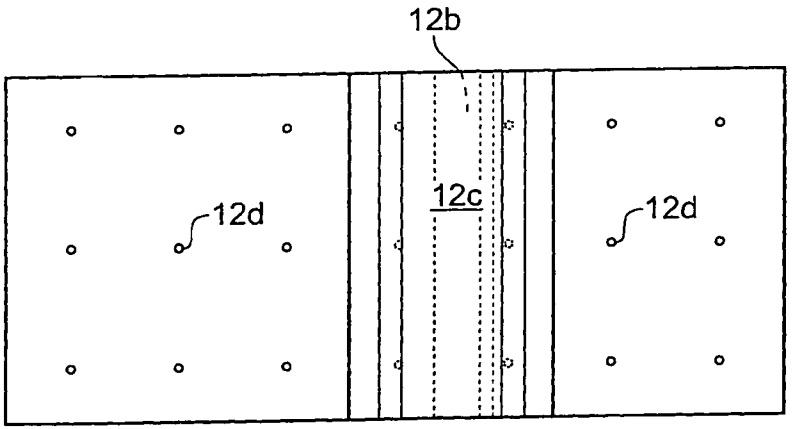
FIG. 11 is a plan view of the configuration of FIG. 3.

FIG. 11 shows this regular pattern in plan view together with the taped section 12*c* and the overlap 12*b*.

Figure 12:
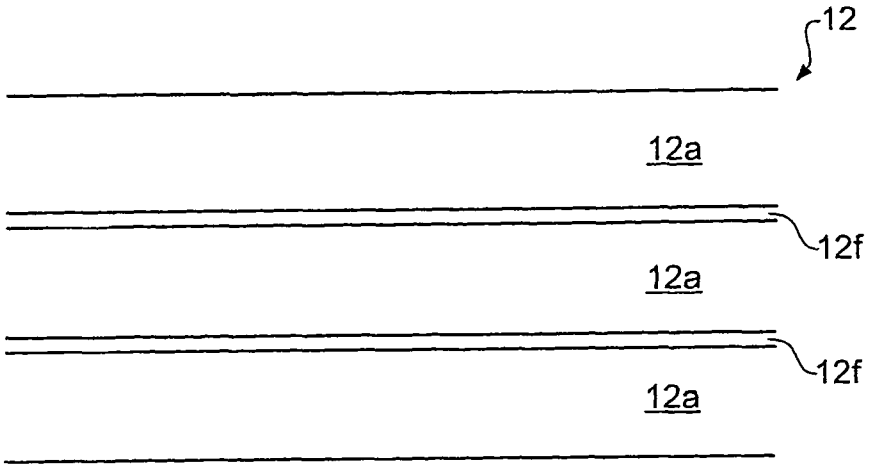
FIG. 12 is a plan view of an alternative configuration of FIG. 3.

FIG. 12 shows alternative openings within the second layer 12. Rather than holes 12*d* slices, slashes or cuts 12*e* are made within the second layer 12.

Figure 13:
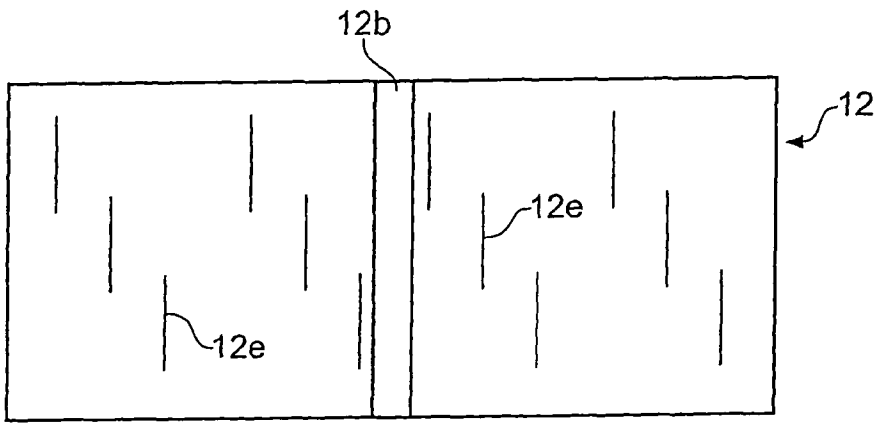
FIG. 13 is a plan view of an alternative laying configuration for the membrane of FIG. 1.

FIG. 13 illustrates another alternative to the holes 12*d* of FIGS. 3 and 4. In this embodiment, the second layer 12 is made up of adjacent sheets 12*a* which are spaced apart with a gap 12*f* left therebetween. These gaps 12*f* act as the openings to allow water to flow through into the sub-base but to minimise evaporation from the sub-base by minimising the area of sub-base which is not covered by an impermeable layer.

Figure 14:
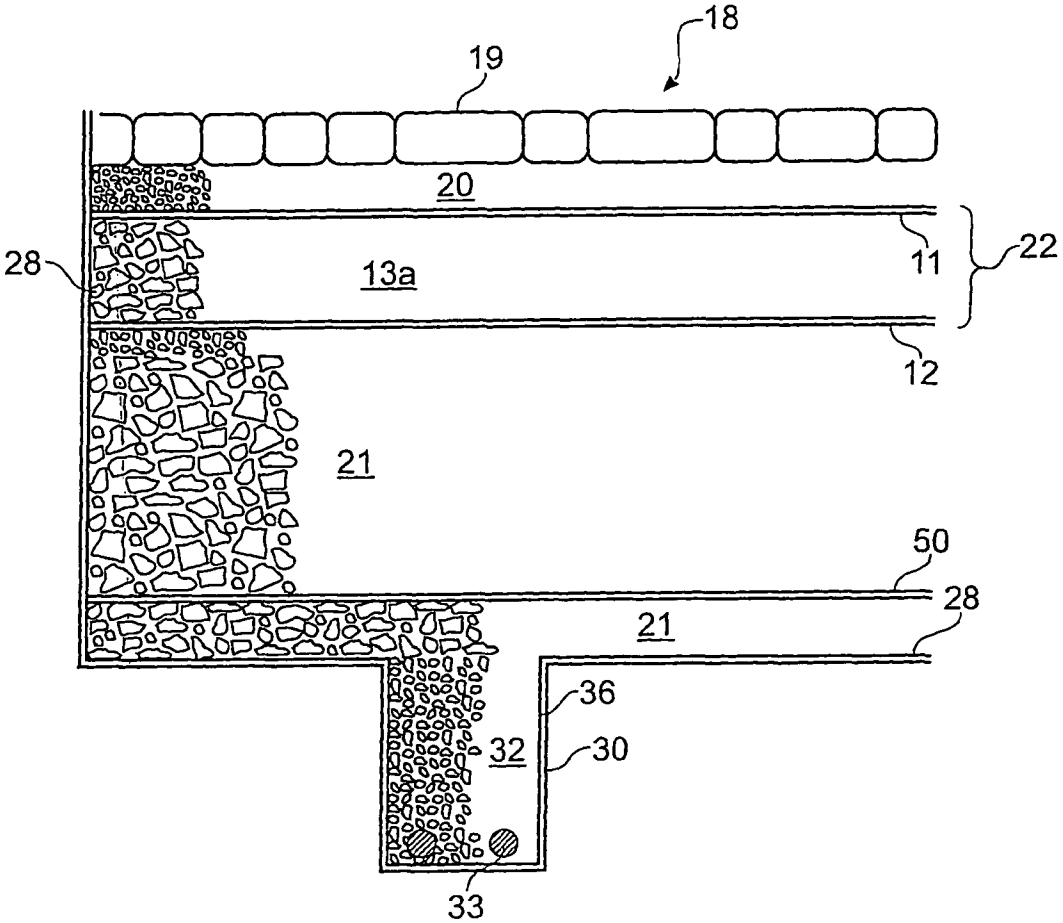
FIG. 14 is a cross section view through a heat exchange structure formed as an embodiment of the present invention and incorporating a membrane of the general type illustrated in FIG. 1.

In FIG. 14 the water detention system of FIG. 9 is adapted to become a heat exchange structure. This is achieved by having a sump 30 formed within the base of the system. The sump is lined with an impermeable layer 36 which could be an extension of the membrane 28. At the bottom of the sump 30 are laid pipes 33 for a heat exchange system. Within the sump 30 a granular material 32 is placed which is smaller in size than the material of the sub-base 21 to protect the pipes from damage due to sharp edges and corners.

The impermeable layer 28 is also shown to continue up one side of the sub-base 21, composite membrane 22, bedding layer 20 and pavement 18. If necessary this layer can be continued around all sides of the structure so as to make it waterproof and to retain as much water within it as possible. Water could then be regulated to flow out of the structure by means of a valve (not shown) placed through the impermeable layer 28 at a selected point.

As described herein the water detention system may be used for multiple purposes and not every feature of this embodiment would necessarily be employed in a practical installation. Where the water detention system is provided to act as a heat sink, for example, it is convenient to maintain a significant body of water within the region defined by the sub-base 21 and the sump 30 so that heat yielded from the pipes 30 (through which, in use, a heat exchange liquid or fluid flows from the appliance or installation generating or using the heat) is lost to the surrounding water. A further description of such a heat exchange system is to be found in British Patent Application No 0418391.9.

Figure 15:
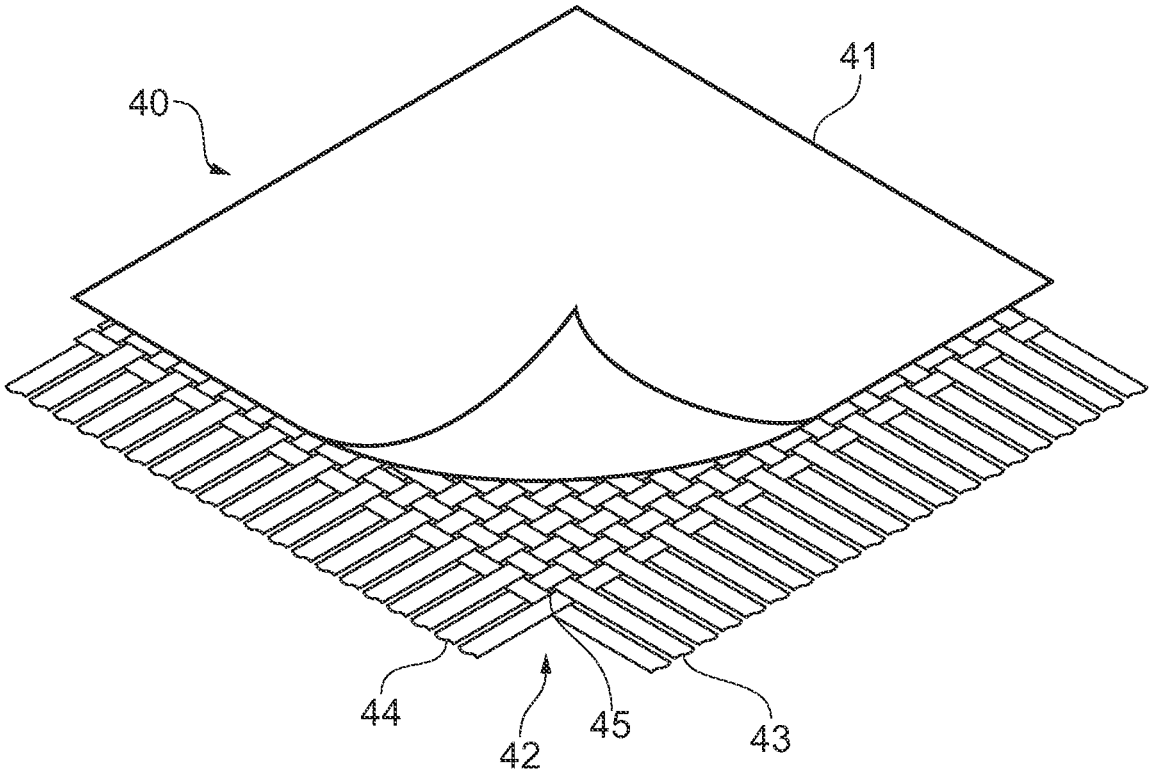
FIG. 15 is a perspective view of alternative composite membrane suitable for use in the water detention system of the present invention.

FIG. 15 shows an alternative at least substantially unidirectionally permeable membrane which may be used in place of the membrane 11 in water detention systems such as those shown in the illustrative drawings referred to hereinabove. In FIG. 15 the unidirectionally porous membrane 40 comprises only two layers, namely an upper permeable non-woven layer 41 and a lower permeable woven layer 42. The upper, permeable, non-woven layer may be composed of plastics filaments of a material commonly used for production of geotextiles for the building industry, which is sufficiently porous to allow water to pass therethrough when it accumulates above the membrane and develops a slight "head" resulting in a hydraulic pressure sufficient to cause the water to pass through the fabric.

The underlying woven plastics layer 42 is composed of closely woven flat plastics strips 43 (in the warp direction) and 44 (in the weft direction). The weave is sufficiently tight that the interstices 45 between adjacent interwoven filaments are extremely small and widely spaced in relation to the overall area covered by the interlocking filaments. Again, these are of a size such that, when water builds up above the composite membrane to provide an hydraulic pressure the liquid water will pass through the interstices 45, albeit being slowed by the relatively small cross sectional area of these openings to allow water to build up in a sub-base underlying the membrane as described hereinabove in relation to the preceding Figures. When it is used in areas of low rainfall or when it is desired for any reason to retain captured water in the sub-base a rise in temperature in the air (and/or the ground) above the membrane which may cause evaporation at the surface of the water retained in the sub-base will not result in substantial loss of retained water since the water vapour cannot readily pass through the composite membrane in the reverse direction due to the small size of the interstices between the woven filaments 43, 44. The close bonding of the two layers 41, 42 together also contributes to this effect. This results in a simple, economical and surprisingly effective unidirectionally porous membrane which resists evaporative loss from the sub-base.

The invention claimed is:

1. A water detention system comprising a sub-base of particulate material in a layer having a substantial number of voids over an at least substantially impermeable sub-grade or a preliminarily positioned at least substantially impermeable membrane, with an overlying substantially unidirectionally porous layer able to allow water to infiltrate from above into the sub-base but which is such as substantially to resist loss of water from the sub-base by evaporation such that water collecting on its upper surface can infiltrate into the sub-base to be retained therein, wherein said substantially unidirectionally porous layer comprises a membrane having an upper nonwoven textile material component the fibres or filaments of which are heat bonded and a lower woven textile component the filaments of which are composed of flat plastics strips, wherein said woven and non-woven components are bonded together, the weave of the flat plastic strips of the lower woven textile component being sufficiently tight so as to provide interstices between adjacent woven filaments to allow water to pass therethrough but which prevent water vapour from escaping whereby to resist evaporative loss from the sub-base.

2. The water detention system according to claim 1, wherein said underlying layer further comprises a cavity forming a sump.

3. The water detention system according to claim 1, wherein said substantially unidirectionally porous layer is itself overlain by a permeable layer of particulate material.

4. The water detention system according to claim 3, wherein said overlying layer is a laying course for a wear layer.

5. The water detention system according to claim 4, wherein said wear layer comprises a plurality of paving elements.

6. The water detention system according to claim 5, wherein said paving elements are blocks or slabs having means defining openings between them when laid in juxtaposed relation.

7. The water detention system according to claim 4, wherein said wear layer comprises a substantially continuous layer of permeable material (such as asphalt, permeable or porous concrete, or the like).

8. The water detention system according to claim 3, wherein said overlying layer of particulate material itself constitutes a wear layer.

9. The water detention system according to claim 3, wherein said overlying layer is itself overlain by soil and/or vegetation.

10. The water detention system according to claim 1, wherein said substantially unidirectionally porous layer comprises a membrane having a non-woven textile material component the fibres or filaments of which are heat bonded.

11. The water detention system according to claim 10, wherein said unidirectionally porous membrane further includes a woven textile component the filaments of which are composed of flat plastics strips.

12. The water detention system according to claim 11, wherein said woven and non-woven components are bonded together.

13. The water detention system of claim 1, further comprising one or more heat exchange pipes for directing a heat exchange fluid therethrough and located so as to pass through water trapped in the said sub-base.

14. The water detention system of claim 13, wherein said sub-base has a channel therein through which the or each said heat exchange pipe passes.

15. The water detention system of claim 14, wherein the said channel is formed by a membrane defining the lower boundary of the said sub-base.

16. The water detention system of claim 15, wherein the channel is formed as a sump in the bottom of the said sub-base.

17. The water detention system of claim 1, wherein said particulate material of said sub-base comprises rigid substantially incompressible material such as crushed rock.

18. A method of forming a water detention system comprising the steps of: laying a sub-base of rigid insoluble hard particulate material of a defined size range over an at least substantially impermeable sub-grade or a preliminarily positioned at least substantially impermeable membrane;

overlaying the sub-base with a substantially unidirectionally porous layer able to allow water to infiltrate from above into the sub-base but which is such as substantially to resist loss of water from the sub-base by evaporation; and overlaying the said substantially unidirectionally porous layer with a layer of particulate material, wherein said substantially unidirectionally porous layer comprises a membrane having an upper nonwoven textile material component the fibres or filaments of which are heat bonded and a lower woven textile component the filaments of which are composed of flat plastics strips, wherein said woven and non-woven components are bonded together, the weave of the flat plastic strips of the lower woven textile component being sufficiently tight so as to provide interstices between adjacent woven filaments to allow water to pass therethrough but which prevent water vapour from escaping whereby to resist evaporative loss from the sub-base.

19. The method according to claim 18, further comprising the step of compacting the material of the sub-base prior to application of the said substantially unidirectionally porous layer.

20. The method according to claim 18, wherein said substantially unidirectionally porous layer is a composite membrane.

* * * * *